US006150907A

United States Patent [19]

Loi et al.

[11] Patent Number: 6,150,907

[45] Date of Patent: Nov. 21, 2000

[54] COUPLING MECHANISM WITH MOVING SUPPORT MEMBER FOR $TE_{011}$ AND $TE_{01\delta}$ RESONATORS

[75] Inventors: Keith N. Loi, Rosemead; Paul J. Tatomir, Laguna Niguel, both of Calif.

[73] Assignee: Hughes Electronics Corporation, El Seguindo, Calif.

[21] Appl. No.: 09/304,328

[22] Filed: May 3, 1999

Related U.S. Application Data

[62] Division of application No. 08/924,450, Aug. 28, 1997, abandoned.

[51] Int. Cl.[7] ..... H01P 1/208

[52] U.S. Cl. ..... 333/212; 333/219.1; 333/230

[58] Field of Search ..... 333/202, 208, 333/209, 212, 219.1, 230

[56] References Cited

U.S. PATENT DOCUMENTS

| | | | |
|---|---|---|---|
| 2,649,576 | 8/1953 | Lewis | 333/122 |
| 3,845,415 | 10/1974 | Ando | 333/135 |
| 4,028,651 | 6/1977 | Leetmaa | 333/212 |
| 4,291,288 | 9/1981 | Young et al. | 333/212 |
| 4,477,785 | 10/1984 | Atia | 333/202 |
| 4,614,920 | 9/1986 | Tong | 333/135 |
| 4,721,933 | 1/1988 | Schwartz et al. | 333/230 |
| 4,746,883 | 5/1988 | Sauvage et al. | 333/202 |
| 4,780,693 | 10/1988 | Elliott et al. | 333/135 |
| 4,980,662 | 12/1990 | Simon et al. | 333/202 X |
| 5,065,119 | 11/1991 | Jachowski | 333/202 |
| 5,268,659 | 12/1993 | Zaki et al. | 333/209 |
| 5,495,216 | 2/1996 | Jachowski | 333/212 X |
| 5,608,363 | 3/1997 | Cameron et al. | 333/202 |
| 5,801,606 | 9/1998 | Schubert et al. | 333/208 |
| 5,805,033 | 9/1998 | Liang et al. | 333/202 |

FOREIGN PATENT DOCUMENTS

| | | | |
|---|---|---|---|
| 55-134502 | 6/1979 | Japan . | |
| 63-302601 | 12/1988 | Japan | 333/202 |
| 1087328 | 11/1965 | United Kingdom . | |
| 88/03711 | 5/1988 | WIPO . | |
| 95/27317 | 10/1995 | WIPO . | |

OTHER PUBLICATIONS

Foreign Patent Document No. 002042875, Pichler et al., filed Dec. 1, 1968.

*Primary Examiner*—Robert Pascal
*Assistant Examiner*—Barbara Summons
*Attorney, Agent, or Firm*—T. Gudmestad; M. W. Sales

[57] ABSTRACT

The present invention is directed to improved coupling mechanisms for $TE_{011}$ and $TE_{01\delta}$ mode resonators. In one embodiment, the coupling mechanism provides an adjustable connection for transferring electromagnetic energy from a first resonator to a second resonator. Once the resonators are coupled, the coupling mechanism is adapted to allow adjustment of the magnitude and/or the phase of the electromagnetic energy while preserving the electromagnetic connection between the resonators. In another embodiment, the coupling mechanism provides a connection of the resonators using a waveguide. By varying the connection of the resonators with respect to the waveguide, positive relative coupling and/or negative relative coupling of the electromagnetic energy transferred between the waveguide and the resonators is provided.

7 Claims, 4 Drawing Sheets

FIG. 1
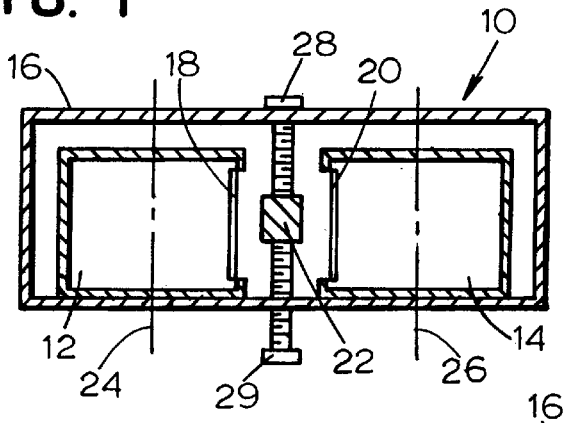
FIG. 2
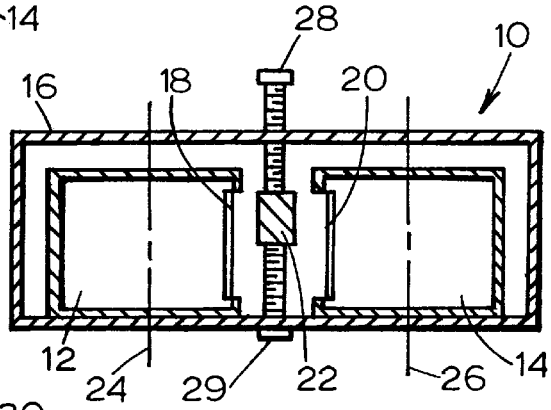
FIG. 3
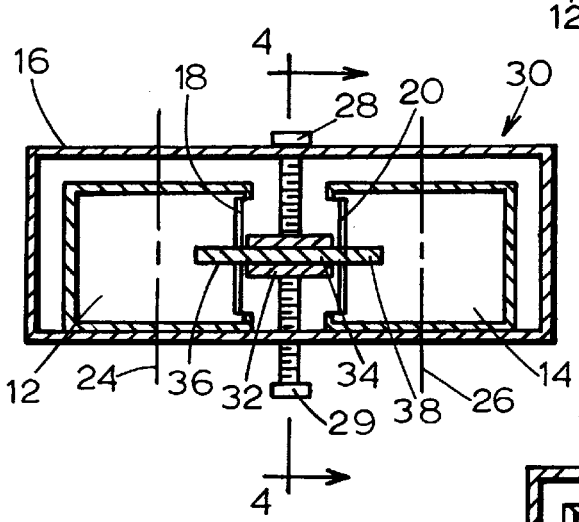
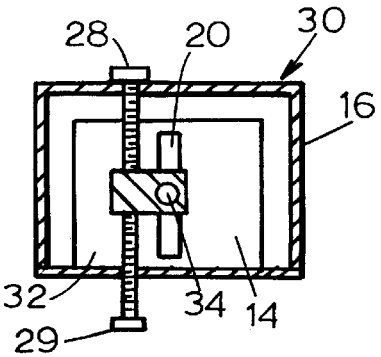
FIG. 4
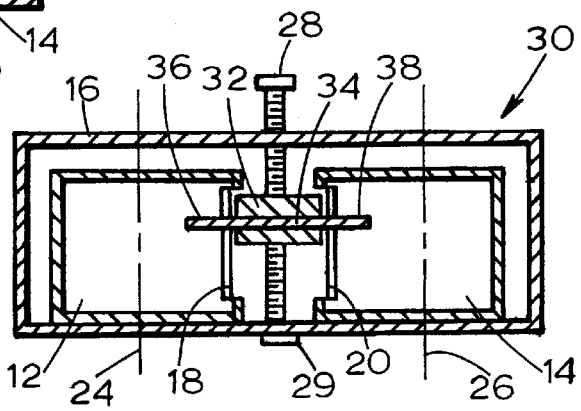
FIG. 5

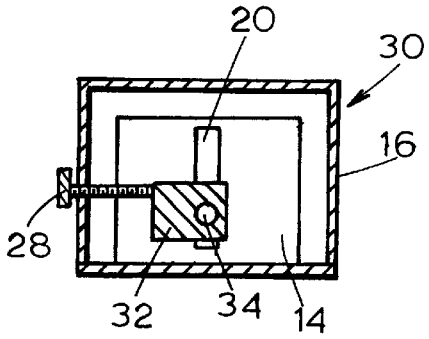
FIG. 6
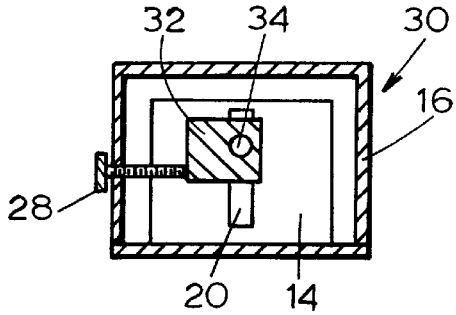
FIG. 7
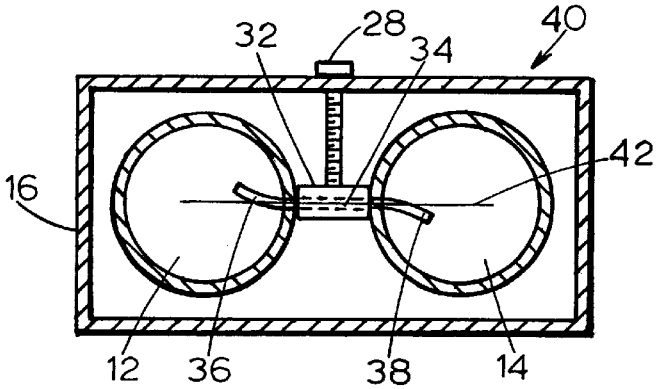
FIG. 8
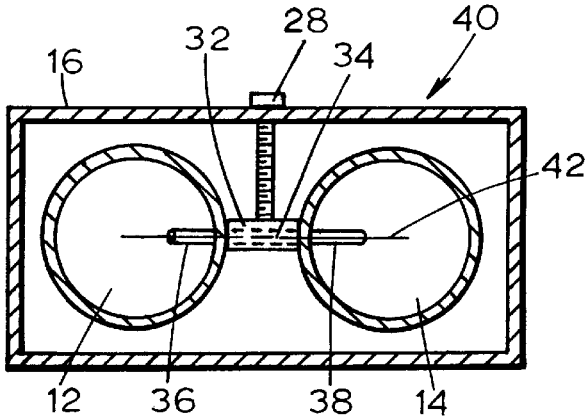
FIG. 9
FIG. 10
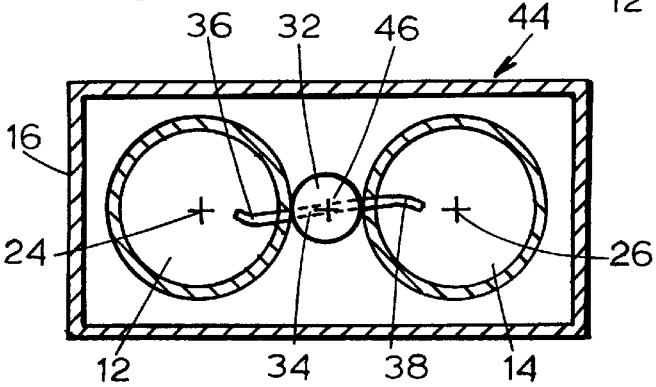

COUPLING MECHANISM WITH MOVING SUPPORT MEMBER FOR $TE_{011}$ AND $TE_{01\delta}$ RESONATORS This is a Division of Application Ser. No. 08/924,450 now abandoned filed Aug. 28, 1997.

BACKGROUND OF THE INVENTION

1. Field of the Invention

The present invention relates generally to cylindrical resonators and, more particularly, to coupling mechanisms for $TE_{01\delta}$ and $TE_{011}$, mode resonators.

2. Description of the Related Art

In numerous electrical devices, such as electromagnetic filters, pairs of resonators are coupled together to pass electromagnetic energy from one resonator to the other resonator. Currently, several different mechanisms are used to couple resonators. In one arrangement used for cylindrical $TE_{011}$ and $TE_{01\delta}$ mode resonators, each of the resonators has a slot in the longitudinal direction that exposes the internal cavity of the resonator to an external environment. The resonators are positioned in close proximity to each other with the slots aligned to couple magnetic fields within the resonators, thereby facilitating communication of the electromagnetic energy between the resonators.

In another arrangement, the resonators are connected by a conductive filament. The end portions of the filament form probes that extend into the inner cavities of the resonators. In this arrangement, the electromagnetic field in one resonator creates a current in the filament which, in turn, creates an electromagnetic field in the other resonator.

In coupling arrangements such as those described above, the coupling mechanism cannot be adjusted after assembly is complete. The electromagnetic field created in the second resonator may be out of phase with the electromagnetic field in the first resonator by a give n amount which is determined by the characteristics of the coupling mechanism. This phase difference is constant regardless of the magnitude of the electromagnetic field in the first resonator. Additionally, the magnitude of the electromagnetic field in the second resonator is varied only by varying the magnitude of the electromagnetic field in the first resonator. In this way, the operation of the coupled resonators is set when the resonators are coupled together.

Therefore, there is a need for an improved coupling mechanism for $TE_{011}$ and $TE_{01\delta}$ resonators that provides an adjustable coupling between the resonators, and which allows adjustment of the magnitude and/or phase of the electromagnetic energy passed from the first resonator to the second resonator. A need also exists for improved coupling mechanisms that couple two resonators with waveguides to provide control of the relative coupling of the electromagnetic energy that is transferred between the waveguide and the coupled resonators.

SUMMARY OF THE INVENTION

The present invention is directed to an improved coupling mechanism for coupling a first electromagnetic field in a first resonator to a second electromagnetic field in a second resonator, and thereby creating an electromagnetic connection to pass electromagnetic energy from the first resonator to the second resonator. The coupling mechanism comprises an adjustable coupler having a first end coupled to the first resonator and a second end coupled to the second resonator. The adjustable coupler is adapted to maintain the electromagnetic connection as the adjustable coupler moves between a first position and a second position. When the adjustable coupler is in the first position, the electromagnetic energy passed through the coupler has a first magnitude and a first phase. When the adjustable coupler is in the second position, the electromagnetic energy has a second magnitude and a second phase.

In one embodiment of the present invention, the first and second resonators are cavity resonators each having a longitudinal axis, an internal cavity, and an exterior slot proximate one of the first and second ends of the adjustable coupler. The adjustable coupler is adapted to move between the first and second positions in a direction parallel to the longitudinal axes of the resonators. When the adjustable coupler is set in the desired position, a fastening member retentively holds the adjustable coupler in place.

In another embodiment of the present invention, the adjustable coupler includes a support member extending between the first and second ends of the adjustable coupler, with a conductive filament passing through the length of the support member. The filament extends beyond the first and second ends of the support member to form first and second probes in the cavities of the first and second resonators, respectively. The first and second resonators may have exterior slots as described above, with the support member and filament adapted to slide within the slots between the first and second positions. Once in the desired position, a fastening member retentively holds the support member in place. In an alternative embodiment, the support member and filament are rotatable about an axis defined by the first and second ends of the adjustable coupler, and the adjustable coupler moves between the first and second position by rotating about the axis. The support member and filament could, alternatively, rotate about an axis parallel to the longitudinal axes of the resonators. In this embodiment, the first and second probes each have a non-linear shape so that the orientation of the probes with respect to the electromagnetic fields changes as the adjustable coupler is rotated between the first and second positions.

In another embodiment, adjustment members, such as dielectric screws, are inserted through the exterior surfaces of the resonators so that they abut the probes. The adjustment members are adapted to cause the deflection of the probes between the first and second positions.

In yet another embodiment of the present invention, a coupling mechanism includes first and second resonators coupled to a waveguide. The waveguide has first and second ends with an outer wall between the ends. The first resonator has a first slot and is coupled to the outer wall at first aperture in the outer wall, and the second resonator has a second slot and is coupled to the outer wall at a second aperture in the outer wall. The first and second slots are separated by a longitudinal distance equal to one-half the wavelength of the electromagnetic energy, thereby providing negative relative coupling. When the electromagnetic energy is input to the waveguide, the electromagnetic fields created in the resonators are 180° out of phase. Similarly, the electromagnetic energy output by the resonators into the waveguide are 180° out of phase when they combine in the waveguide.

Alternatively, the apertures and, consequently, the resonators are equidistant from the first end in the longitudinal direction, either on the outer wall or on the second end. In this arrangement, the resonators are equidistant from the first end of the waveguide and electromagnetic energy either received or transmitted by the resonators are in phase. Consequently, this arrangement provides positive relative coupling of the resonators.

The features and advantages of the invention will be apparent to those of ordinary skill in the art in view of the detailed description of the preferred embodiment, which is made with reference to the drawings, a brief description of which is provided below.

BRIEF DESCRIPTION OF THE DRAWINGS

FIG. 1 is a front elevation sectional view of two $TE_{011}$ mode cylindrical cavity resonators coupled with an adjustable dielectric rod in a first position according to the present invention;

FIG. 2 is a front elevation sectional view of two $TE_{011}$ mode resonators coupled by an adjustable dielectric rod in a second position according to the present invention;

FIG. 3 is a front elevation sectional view of two $TE_{011}$ mode resonators coupled by an adjustable conductive filament in a first position according to the present invention;

FIG. 4 is a side elevation sectional view taken along line 4—4 of an adjustable conductive filament coupling mechanism according to the present invention;

FIG. 5 is a front elevation sectional view of two $TE_{011}$ mode resonators coupled by an adjustable filament in a second position according to the present invention;

FIG. 6 is a side elevation sectional view of an alternative embodiment of the adjustable conductive filament of FIG. 4 in a first position;

FIG. 7 is a side elevation sectional view of an alternative embodiment of the adjustable conductive filament of FIG. 4 in a second position;

FIG. 8 is a top sectional view of two $TE_{011}$ mode resonators coupled by a rotatably adjustable filament in a first position according to the present invention;

FIG. 9 is a top sectional view of two $TE_{011}$ mode resonators coupled by a rotatably adjustable filament in a second position according to the present invention;

FIG. 10 is a top sectional view of two $TE_{011}$ mode resonators coupled by an alternative rotatably adjustable filament in a first position according to the present invention;

DETAILED DESCRIPTION OF THE PREFERRED EMBODIMENTS

Figure 11:
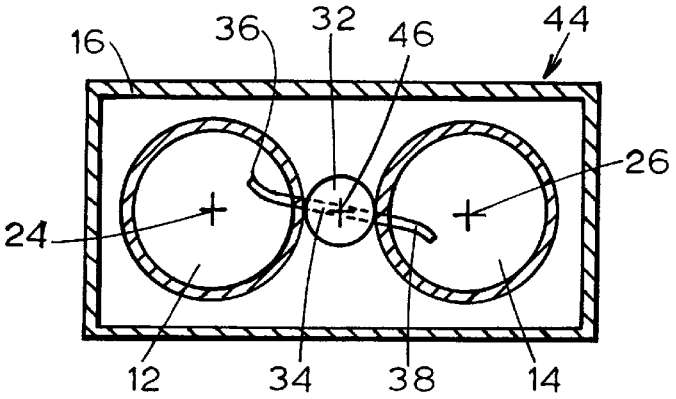
FIG. 11 is a top sectional view of two $TE_{011}$ mode resonators coupled by an alternative rotatably adjustable filament in a second position according to the present invention.

A first embodiment of a coupling mechanism 10 for two $TE_{011}$ mode cylindrical cavity resonators 12, 14 is shown in FIGS. 1 and 2. Referring to FIG. 1, the resonators 12, 14 are positioned side-by-side in a housing 16. The resonators 12, 14 have corresponding slots 18, 20 in their outer walls which are aligned with a dielectric rod 22 along a line between the center lines 24, 26 of the resonators 12, 14. The dielectric rod 22 adjusts the cutoff frequency of the slots 18, 20 by moving up and down in a direction parallel to the center lines 24, 26 of the resonators 12, 14. A pair of screws 28, 29 are inserted through the top and bottom of the housing 16 and engage the dielectric rod 22.

When the screws 28, 29 are turned in the appropriate direction, the screws 28, 29 cause the dielectric rod 22 to slide upwardly within the slots 18, 20 between the first position illustrated in FIG. 1 and the second position illustrated in FIG. 2. Turning the screws 28, 29 in the other direction will cause the dielectric rod 22 to move downwardly from the second position illustrated in FIG. 2 to the first position illustrated in FIG. 1. It will be obvious to those of ordinary skill in the art that the double-screw arrangement shown in FIGS. 1 and 2 can be replaced by a single screw with the dielectric rod 22 affixed to the end, or by using a dielectric screw that extends into the area between the slots 18, 20. These alternatives are contemplated by the inventors as having use in connection with the present invention.

The movement of the dielectric rod 22 between the first and second positions changes the magnitude and phase of the electromagnetic energy transferred between the resonators 12, 14. The magnitude of the magnetic field in the resonator 12 is greatest at the cylindrical wall in the longitudinal center of the resonator 12, and decreases toward the top and bottom of the resonator 12. As the dielectric rod 22 moves from the first position of FIG. 1 towards the second position of FIG. 2, the distance between the dielectric rod 22 and the center of the resonators 12, 14 increases. Consequently, the magnitude of the electromagnetic energy transferred between the resonators 12, 14 decreases. Additionally, the increased distance the electromagnetic energy travels between the center of the first resonator 12 and the second resonator 14 increases the phase shift between the electromagnetic fields in the resonators 12, 14.

The coupling mechanisms discussed and illustrated herein can be used in a similar manner to couple a pair of cylindrical cavity resonators containing dielectric pucks, also known as $TE_{01\delta}$ mode resonators. The effects of using dielectric pucks in cavity resonators to alter the impedance of the resonators are well known to those in the art. Therefore, the use of the coupling mechanisms described herein to couple $TE_{01\delta}$ mode resonators will be obvious to those of ordinary skill in the art and is contemplated by the inventors in connection with the present invention. Additionally, the positioning of the dielectric pucks within the resonators may be adjustable in both the longitudinal and radial directions through the use of dielectric set screws, and is also contemplated by the inventors in connection with the present invention.

FIGS. 3–5 illustrate a second embodiment of a coupling mechanism 30 in accordance with the present invention. As discussed in the previous embodiment, a pair of resonators 12, 14 are placed side by side within a housing 16 with corresponding slots 18, 20 in the outer surfaces of the resonators 12, 14. In this embodiment, the dielectric rod 22 of the coupling mechanism 10 is replaced by a support member 32 and a conductive filament 34, which is fabricated from a highly conductive material such as silver or copper. The filament 34 runs through the length of the support member 32, and extends beyond the support member 32 through the slots 18, 20 to form probes 36, 38 within the cavities of the resonators 12, 14, respectively. The support member 32 is engaged by the screw 28 to facilitate the sliding of the support member 32 and the filament 34 within the slots 18, 20 as illustrated in FIG. 4. In this embodiment, the support member 32 and the screws 28, 29 are either metallic or fabricated from a dielectric plastic, such as Ultem®.

By rotating the screws 28, 29 in one direction, the support member 32 and filament 34 slide from the first position illustrated in FIG. 3 to the second position shown in FIG. 5. Rotating the screws 28, 29 in the opposite direction will then move the support member 32 of the filament 34 from the second position illustrated in FIG. 5 to the first position illustrated in FIG. 3. Movement of the support member 32 and the filament 34 in this manner will have a similar affect on the magnitude and phase of the electromagnetic energy passed between the resonators 12, 14 as described previously in relation to the dielectric rod of the coupling mechanism 10.

FIGS. 6 and 7 illustrate an alternative embodiment for the coupling mechanism 30 where the screw 28 functions as a set screw which is tightened to engage support member 32 when the support member 32 and filament 34 are manually moved into the desired position. Initially, the screw 28 holds the support member 32 in the first position illustrated in FIG. 6. The screw 28 is then unscrewed to free the support member 32 for slidable movement of the filament 34 in the slots 18, 20. The support member 32 is moved to a second position as illustrated in FIG. 7, by removing a top wall of the housing (not shown) and manually sliding the support member 32. The screw 28 is retightened to once again engage the support member 32, thereby holding it in the second position.

FIGS. 8 and 9 illustrate another embodiment of a coupling mechanism 40 according to the present invention. In this embodiment, the support member 32 is cylindrically shaped with an axis of rotation around of the points where the probes 36, 38 enter the resonators 12, 14, respectively. The probes 36, 38 have a non-liner shape whereby the ends of the probes 36, 38 are positioned off the axis of rotation 42 of the support member 32. The screw 28 acts as a set screw which is tightened to retentively engage the support member 32 after the support member 32 is rotated to the desired position. In order to adjust the positioning of the support member 32 and the filament 34, the screw 28 is loosened to allow the support member 32 to rotate from a first position as shown in FIG. 8 to a second position as shown in FIG. 9, shown here to be a relative rotation of approximately 90° from the first to the second position. Once in the desired position, the screw 28 is again tightened to retentively engage the support member 32 to prevent further rotation.

In the coupling mechanism 44 illustrated in FIGS. 10 and 11, the dielectric support member 32 is cylindrically shaped with an axis of rotation 46 aligned parallel to the center lines 24, 26 of the resonators 12, 14, respectively, and lies along a line between the center lines 24, 26. A set screw (not shown) enters through either the top or the bottom of the housing 16 and engages the support member 32 to fix the support member 32 at a fixed point of rotation about the axis 46. The probes 36, 38 have a non-liner shape and enter the resonators 12, 14 through slots which are aligned perpendicular to the axis 46 and the center lines 24, 26. In order to adjust the positioning of the support member 32 and the filament 34, the set screw 28 is loosened to allow the support member 32 to rotate from a first position as shown in FIG. 10 to a second position as shown in FIG. 11. Once in the desired position, the screw 28 is again tightened to retentively engage the support member 32 to prevent further rotation.

Figure 12:
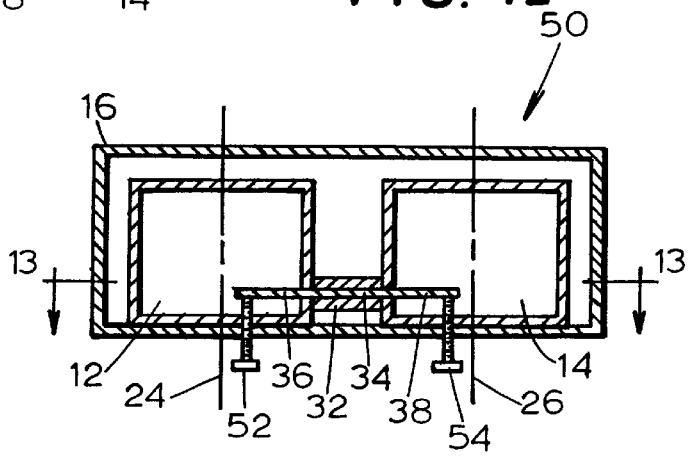
FIG. 12 is a front elevation sectional view of two $TE_{011}$ mode resonators coupled by an adjustable filament in a first position according to an alternative embodiment of the present invention.
Figure 13:
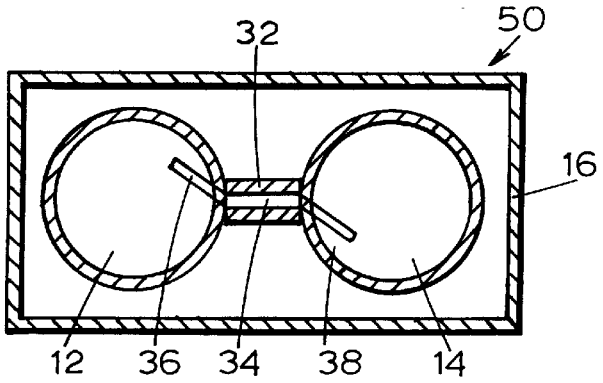
FIG. 13 is a top sectional view taken along line 13—13 of two $TE_{011}$ mode resonators coupled by an adjustable filament according to an alternative embodiment of the present invention.
Figure 14:
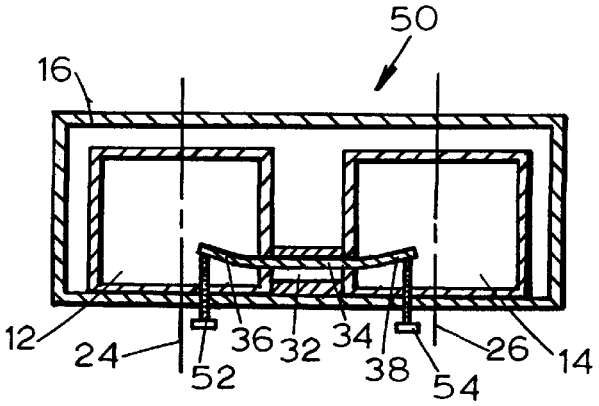
FIG. 14 is front elevation sectional view of two $TE_{011}$ mode resonators coupled by an adjustable filament deflected to a second position according to an alternative embodiment of the present invention.

Yet another embodiment of a coupling mechanism 50 according to the present invention is shown in FIGS. 12–14. In this embodiment, the cylindrical cavity resonators 12, 14 are coupled by the filament 34 enclosed in the support member 32. The probes 36, 38 enter the resonators 12, 14, respectively, along non-diametral cords as illustrated in FIG. 13. Dielectric screws 52, 54 are inserted through the housing 16 and into the resonators 12, 14, respectively, and abut the probes 36, 38, respectively. By rotating the dielectric screws 52, 54 in one direction, the dielectric screws 52, 54 deflect the probes 36, 38 from the first position as shown in FIG. 12 to a second deflected position as shown in FIG. 14. By turning the dielectric screws 52, 54 in the opposite direction, the probes 36, 38 are returned from the second position of FIG. 14 to the initial position shown in FIG. 12. As discussed in relation to the previous embodiments, by varying the distance between the probes 36, 38 and the centers of the resonators 12, 14 in this manner, the magnitude of the electromagnetic energy transferred between the resonators 12, 14 can be adjusted to reach a desired value.

Figure 15:
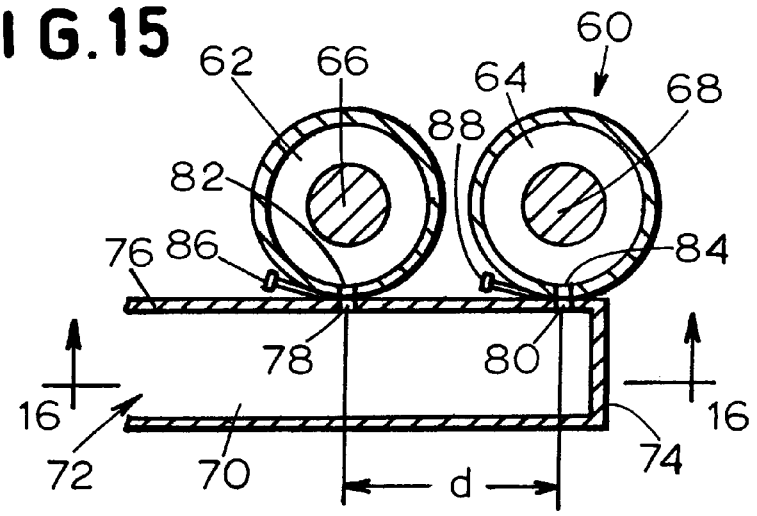
FIG. 15 is a top sectional view of two $TE_{01\delta}$ mode resonators coupled in parallel by a waveguide for negative relative coupling according to the present invention.
Figure 16:
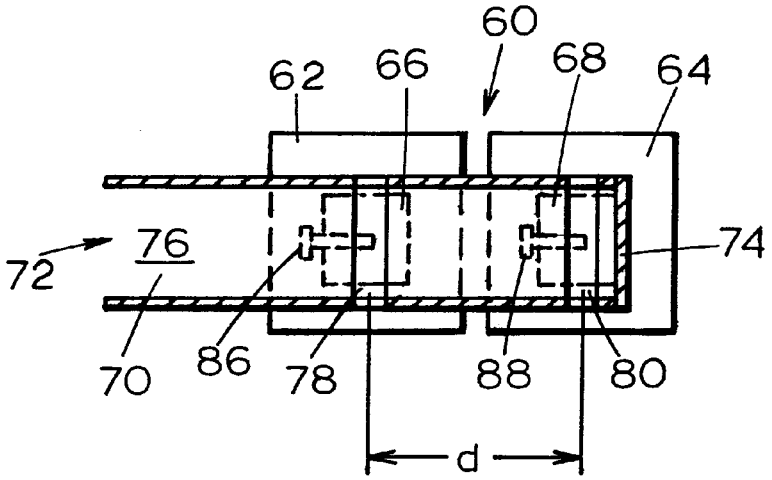
FIG. 16 is a side sectional view taken along line 16—16 of two $TE_{01\delta}$ mode resonators coupled in parallel by a waveguide for negative relative coupling according to the present invention.
Figure 17:
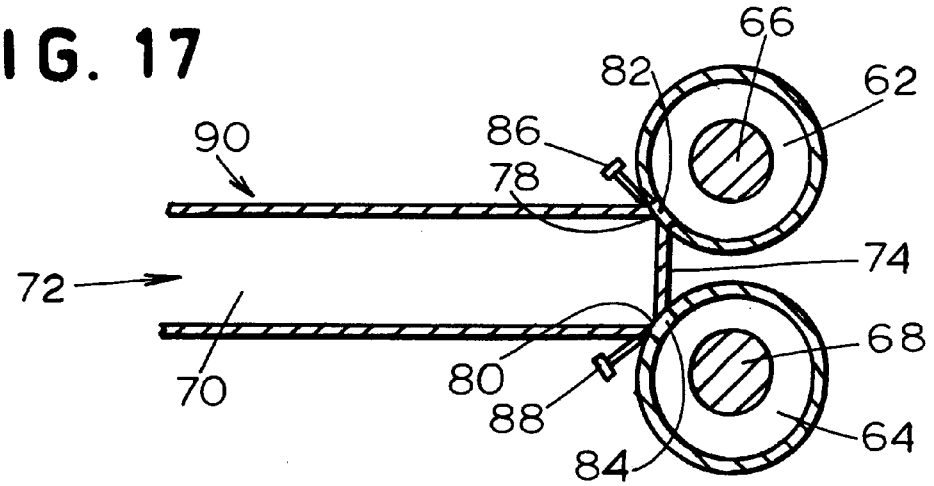
FIG. 17 is a top sectional view of two $TE_{01\delta}$ mode resonators coupled in parallel by a waveguide for positive relative coupling according to the present invention.

FIGS. 15–17 illustrate alternative embodiments of the present invention wherein $TE_{01\delta}$ mode resonators 62, 64 containing dielectric pucks 66, 68 are coupled by a waveguide 70. The open end 72 of the waveguide 70 provides either an input for electromagnetic energy that is transferred into the resonators 62, 64, or an output for the combined electromagnetic energy created by the electromagnetic fields of the resonators 62, 64. Referring to FIGS. 15–16, the coupling mechanism 60 achieves negative relative coupling of the resonators 62, 64 when the resonators 62, 64 are coupled to an outer wall 76 of the waveguide 70. The outer wall 76 has first and second apertures 78, 80 to which corresponding slots 82, 84 of the resonators 62, 64, respectively, are coupled. This coupling forms an electromagnetic connection that facilitates the transfer of electromagnetic energy between the resonators 62, 64 and the waveguide 70. Dielectric or metallic screws 86, 88, are inserted into the coupled apertures 78, 80 and slots 82, 84, respectively, to provide adjustment of the magnitude of the electromagnetic energy transferred between the waveguide 70 and the resonators 62, 64.

Negative relative coupling is achieved in the coupling mechanism 60 when the apertures 78, 80 are separated by a distance d equal to one-half the wavelength of the resonant frequency of the resonators 62, 64. When electromagnetic energy is input to the waveguide 70 at end 72, the electromagnetic energy enters the first resonator 62 through the aperture 78 and slot 82, thereby creating an electromagnetic field in the resonator 62 having the resonant frequency of the resonator 62. The electromagnetic energy travels an additional one-half wavelength to cover the distance d before entering the second resonator 64 through aperture 80 and slot 84. The electromagnetic energy creates an electromagnetic field in the second resonator 64 having the same resonant frequency as the first resonator 62, but is 180° out of phase relative to the electromagnetic field in the first resonator 62 due to the added distance d.

Negative relative coupling is also achieved in the opposite direction in the waveguide coupling mechanism 60. When electromagnetic energy is input to the resonators 62, 64, electromagnetic fields are created which are in phase. The resonator 64 outputs a first output electromagnetic energy having the resonant frequency to the waveguide 70 across the coupling at slot 84 and aperture 80. The first output electromagnetic energy travels the distance d and combines with a second output electromagnetic energy also having the resonant frequency which enters the waveguide 70 from the resonator 62 across the coupling at slot 82 and aperture 78. At the point where the first and second output energies combine, the first and second output electromagnetic energies are 180° out of phase. The combined output electromagnetic energy is then supplied to a load coupled to the end 72 of the waveguide 70.

FIG. 17 illustrates an alternative waveguide coupling mechanism 90 wherein positive relative coupling is achieved. Positive relative coupling of the resonators 62, 64 occurs when the resonators 62, 64 are coupled to the waveguide 70 at equal longitudinal distances from the open end 72. As shown in FIG. 17, this can occur when the resonators 62, 64 are coupled to the end wall 74. The end wall 74 has first and second apertures 78, 80 to which corresponding slots 82, 84 of the resonators 62, 64, respectively, are coupled. This coupling forms an electromagnetic connection that facilitates the transfer of electromagnetic energy between the resonators 62, 64 and the waveguide 70. Dielectric or metallic screws 86, 88 are inserted into the coupled apertures 78, 80 and slots 82, 84, respectively, to provide adjustment of the magnitude of the electromagnetic energy transferred between the waveguide 70 and the resonators 62, 64.

When electromagnetic energy is input to the waveguide 70 at end 72, the input energy travels the same distance before entering the resonators 62, 64 through the apertures 78, 80 and slots 82, 84, respectively, thereby creating electromagnetic fields in the resonators 62, 64 having the resonant frequency of the resonators. Because the input electromagnetic energy travels the same distance from the end 72 to both resonators 62, 64, the electromagnetic fields created in the resonators 62, 64 are in phase. Similarly, if electromagnetic fields are created in the resonators 62, 64 by inputting electromagnetic energy, and the fields are in phase, the first and second output electromagnetic energies transferred to the waveguide through the slots 82, 84 and the apertures 78, 80 are also in phase, thereby resulting in positive relative coupling of the output electromagnetic energy.

While the present invention has been described with reference to the specific examples, which are intended to be illustrative only and not to be limiting of the invention, it will be apparent to those of ordinary skill in the art that changes, additions, and/or deletion may be made to the disclosed embodiment without departing from the spirit and scope of the invention.

What is claimed is:

1. A coupling mechanism for coupling a first electromagnetic field in a first resonator to a second electromagnetic field in a second resonator to create an electromagnetic connection between the first and second resonators for passing electromagnetic energy comprising:

an adjustable coupler having a first end proximate the first resonator and a second end proximate the second resonator, the adjustable coupler adapted to maintain the electromagnetic connection as the adjustable coupler moves between a first position and a second position;

a support member extending from the first end of the adjustable coupler to the second end of the adjustable coupler, wherein the support member moves between the first and second positions; and a conductive filament passing through the length of the support member between the first and second ends, wherein the filament has a first probe extending beyond the first end and into the first resonator and a second probe extending beyond the second end and into the second resonator;

wherein the electromagnetic energy has a first magnitude and a first phase when the adjustable coupler is in the first position and a second magnitude and second phase when the adjustable coupler is in the second position.

2. A coupling mechanism according to claim 1, wherein the support member and the filament are rotatable about a rotational axis defined by the first and second ends and the adjustable coupler moves between the first and second positions by rotating about the rotational axis.

3. A coupling mechanism according to claim 1, wherein the adjustable coupler further comprises a fastening member for retentively holding the support member in the first and second positions.

4. A coupling mechanism according to claim 1, wherein the support member is fabricated from a dielectric material.

5. A coupling mechanism according to claim 1, wherein the first and second probes each have a non-linear shape.

6. A coupling mechanism according to claim 5, wherein the first and second probes are arc-shaped.

7. A coupling mechanism according to claim 1, wherein the resonators contain a dielectric material.

* * * * *